United States Patent [19]

Libit

[11] 4,441,637

[45] Apr. 10, 1984

[54] DISPENSING TYPE CAP CLOSURE

[76] Inventor: Sidney M. Libit, 141 Lakeside Ter., Glencoe, Ill. 60022

[21] Appl. No.: 326,416

[22] Filed: Dec. 1, 1981

Related U.S. Application Data

[63] Continuation-in-part of Ser. No. 264,129, May 15, 1981.

[51] Int. Cl.[3] ..... B65D 47/00; B67D 3/00

[52] U.S. Cl. ..... 222/556; 215/235; 220/335

[58] Field of Search ..... 220/335; 222/534–536, 222/556, 558, 498; 215/235

[56] References Cited

U.S. PATENT DOCUMENTS

| | | | |
|---|---|---|---|
| 1,300,528 | 4/1919 | Weeks | 220/335 |
| 1,687,482 | 10/1928 | Gillette | 220/335 |
| 3,321,115 | 5/1967 | Rendahl | 222/556 |
| 4,124,151 | 11/1978 | Hazard | 222/556 |

*Primary Examiner*—H. Grant Skaggs

*Attorney, Agent, or Firm*—Hill, Van Santen, Steadman & Simpson

[57] ABSTRACT

A relatively lightweight dispensing cap closure includes a base cap portion for attaching to a container opening and a closure portion mounted for pivotable movement in a depressed socket formed in a top surface of the cap. The top surface is formed with a dispensing orifice and the closure portion is formed with a stopper member which cooperates with the dispensing orifice to open and close the cap. The closure portion has a downturned rear flange portion which is received in the socket to permit the closure portion to lie in a substantially horizontal, closed condition with the stopper plugging the dispensing orifice and a substantially upright, opened condition whereby the closure portion is positioned out of the flow path through the dispensing orifice. The flange portion of the closure is formed with an engaging means as is a front wall of the socket which retain the closure in the full open position. A stop surface is provided to limit pivotal movement of the closure portion in the opened condition.

11 Claims, 11 Drawing Figures

FIG 1
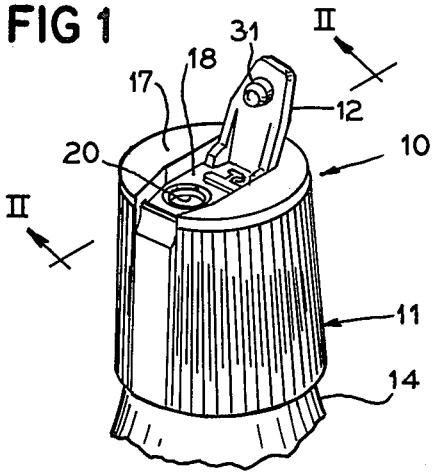
FIG 2
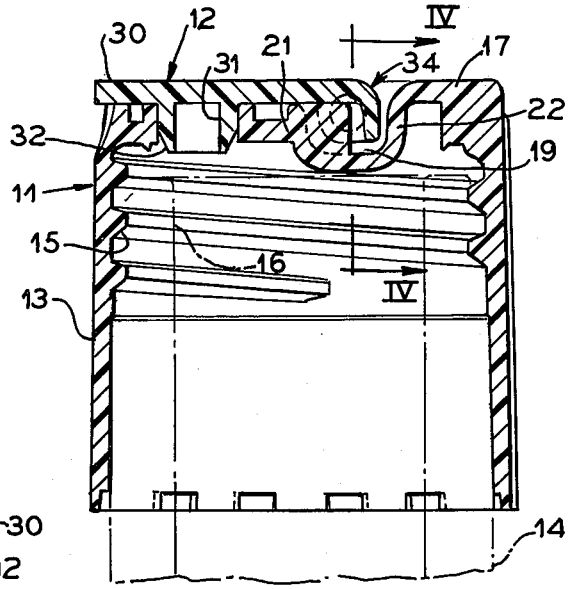
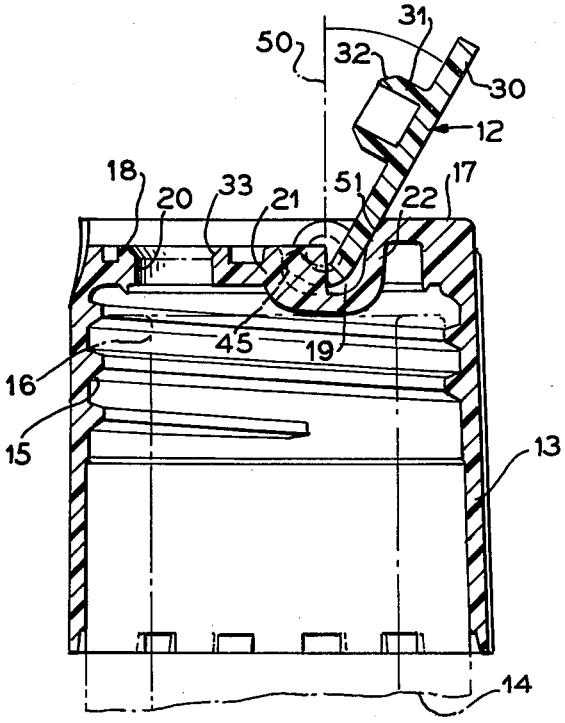
FIG 3
FIG 4
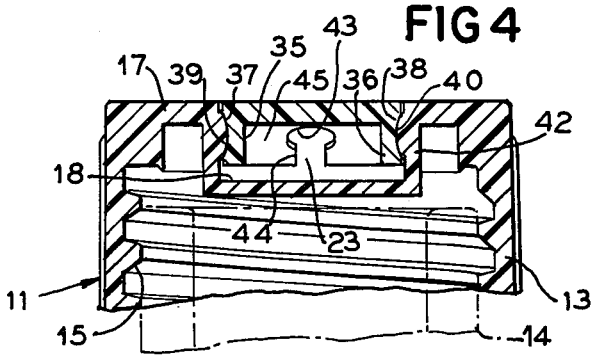
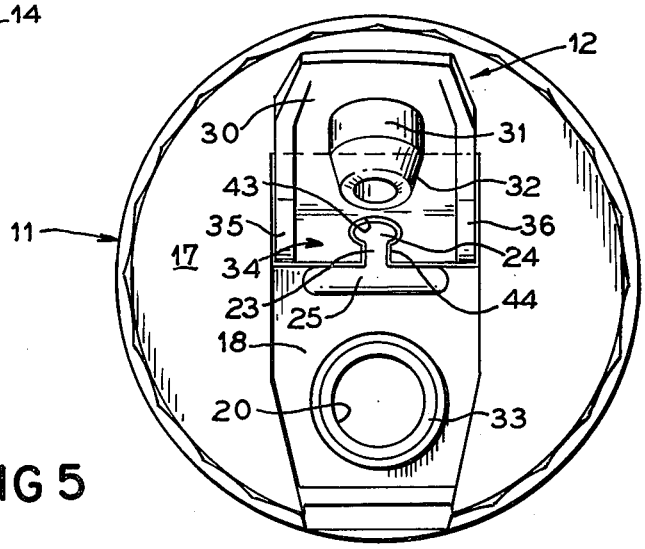
FIG 5

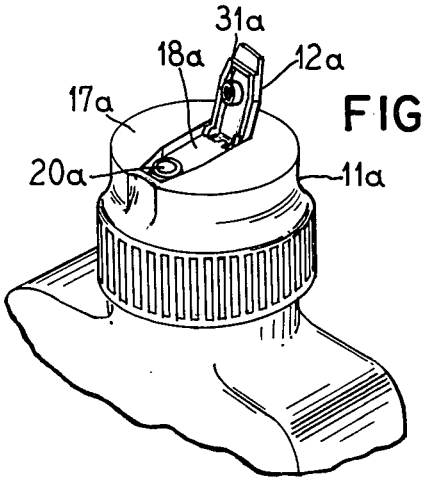
FIG 6
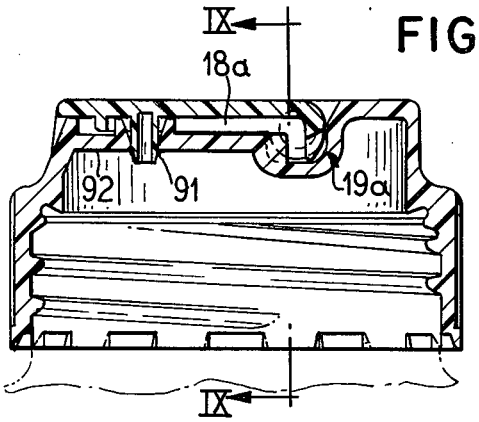
FIG 7
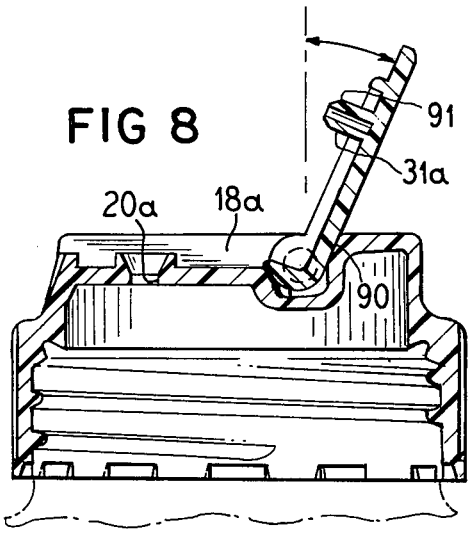
FIG 8
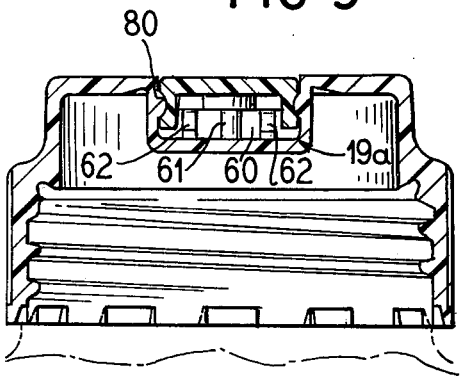
FIG 9
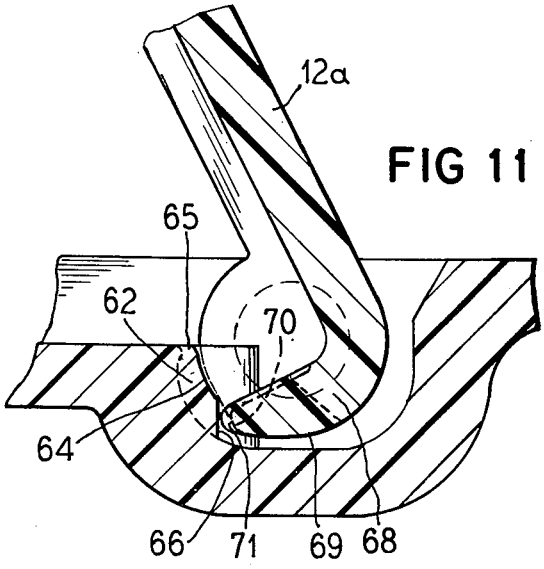
FIG 11
FIG 10
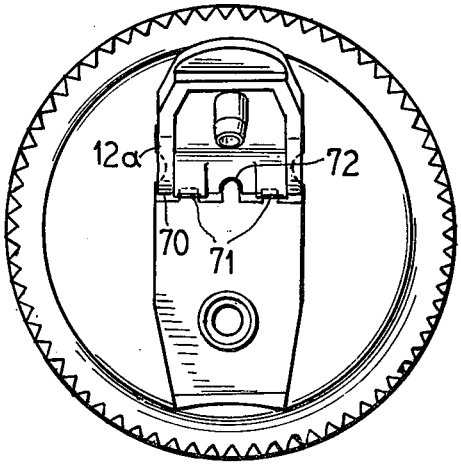

DISPENSING TYPE CAP CLOSURE

BACKGROUND OF THE INVENTION

This application is a continuation-in-part of application Ser. No. 264,129 by the same inventor, entitled "DISPENSING TYPE CAP CLOSURE", filed May 15, 1981.

FIELD OF THE INVENTION

The invention relates to a container cap having a pivotable dispensing closure portion and, more particularly, to a simplified and lightweight construction therefor.

PRIOR ART

Dispensing closures of the type which includes a base cap portion for attaching to a container opening, such as a bottle mouth, and a closure member held in the cap for swiveling movement between closed and opened conditions are well-known in the art. U.S. Pat. Ser. No. 3,111,245 discloses one such swivelable dispensing closure. The closure portion is formed with a spout or nozzle part connected to a relatively large knuckle portion with a dispensing bore running longitudinally therethrough. The knuckle portion fits into a depressed socket formed on the cap base portion and is swivelable therein between a vertical opened condition, whereby the dispensing bore mates with a discharge opening formed in the bottom of the socket, and a generally horizontal closed condition, whereby the knuckle portion blocks the discharge opening. A further swivel spout dispensing closure construction is disclosed in U.S. Pat. Ser. No. 3,502,248. There, the closure member is similarly formed with a nozzle portion connected to a rounded knuckle portion which fits into a socket recess formed in the base cap portion for swivelable movement between a vertical opened condition and a generally horizontal closed condition. The knuckle portion is generally cylindrical and formed at opposed outer ends with lug-type members rotatably received in bearing openings formed in the sidewalls of the socket cavity.

One drawback with the prior art dispensing closures is that a large amount of material must be used in their construction. For this reason, the prior art dispensing closures tend to be of relatively heavy weight. Furthermore, the closure portions are relatively difficult to move between their opened and closed conditions. The present invention obviates these disadvantages by providing for a dispensing closure arrangement which is of relatively lightweight construction and, hence, more economical to produce and which is relatively easy to open and close.

SUMMARY OF THE INVENTION

A relatively lightweight dispensing closure comprises a cap base portion for sealably fitting over a container opening, such as a bottle mouth, and a closure portion which is pivotally mounted in a depressed socket formed in the top of the cap. A dispensing orifice extends through the cap top. The closure portion is formed with a stopper member dimensioned to be received in the dispensing orifice in substantially sealing relation when the closure portion is in a lowered or substantially horizontal closed condition. The closure portion is provided with a rearward downturned flange portion which is positioned within the socket. The flange has opposed side surfaces formed with recesses which cooperatively engage with projecting dimples formed on opposed sidewall portions of the socket, thus permitting snap receipt of the closure portion in the socket and pivotable rotation of the closure portion on the cap between its closed condition and a substantially upright opened condition, whereby the stopper is moved out of and away from the dispenser opening.

The stopper may be force fit into the dispensing orifice so as to provide a resilient force which enables the relatively lightweight closure portion to snap travel to its opened condition readily with application of only a slight upward force on the closure portion.

The flange is formed with a back wall containing an opening for passing about a raised post member located adjacent the forward end of the socket. The post contains a bulbous end portion and the opening has a throat portion relatively narrower than the width of the post bulb. When the closure portion is pivoted in its opened condition, the bulb is forced into the throat causing the flange portion to be thrust forwardly. This action pivots the closure portion fully backward from the initial opened condition until the flange back wall abuts against a planar surface formed on a socket front wall and the upper surface of the closure portion abuts against a slanted planar surface formed along the socket back wall. In this manner, the closure portion is held in a full open position spacing the stopper more than 90° away from the dispensing orifice such that discharge flow through the orifice is not obstructed. The pivotal movement of the closure portion is thus limited so that the closure portion cannot be snapped out of the socket by bending the closure portion too far back away from the dispensing orifice.

In a second embodiment, the flange is provided with spaced projecting pads lying on either side of the opening and the socket is provided with a forward wall portion defining a level change within the socket from a most depressed rearward portion receiving the pivot section and flange of the closure portion and a forward portion lying on a higher plane. The forward wall has projecting therefrom into the most depressed section a central post and a pair of bosses. The bosses are aligned with the pads and are dimensioned such that they are contacted by the pads when the closure has been rotated to a point less than vertical with respect to the top of the cap. Thereafter, further rotation will cause the pads to engage the bosses. The bosses have arcuate faces generated on an arc designed to create an interference fit with the pads. Thus, due to the resiliency of the material of the cap, the snap fit of the closure into the socket and the resiliency of the material of the closure, further movement of the closure to engage the pads with the arcuate surfaces of the boss will increase resistance to rotation of the closure. If desired, the positioning of the back wall of the socket can be such that the closure top will engage the back wall of the socket as the pads reach the top of the boss. The engagement of the end of the post with the end of the opening will prevent the closure from being pryed out of the socket by the fulcrum action of the top of the closure acting against the top edge of the back wall of the socket while the friction fit of the pads and bosses will resist closure rotation of the closure. A snap condition exists as the pads disengage the bosses during the closure motion as well as during the opening motion when the pads first engage the bosses. In this embodiment, the post does not have to be formed with a bulbous end, nor does the closure opening require a restrictive throat.

BRIEF DESCRIPTION OF THE DRAWINGS

FIG. 1 is a perspective elevational view of a lightweight dispensing cap closure constructed in accordance with the present invention.

FIG. 2 is a cross-sectional side elevational view taken along the lines II—II of FIG. 1 with the closure portion in the closed condition.

FIG. 3 is a cross-sectional side elevational view of the dispensing cap closure of FIG. 2 with the closure portion in the opened condition.

FIG. 4 is a fragmentary cross-sectional view taken along the lines IV—IV of FIG. 2.

FIG. 5 is a top plan view of the dispensing cap closure shown in FIG. 1.

FIG. 6 is a view similar to FIG. 1 showing another embodiment of this invention.

FIG. 7 is a view similar to FIG. 2 showing the embodiment of FIG. 6.

FIG. 8 is a view similar to FIG. 3 showing the embodiment of FIG. 6.

FIG. 9 is a sectional view taken along the lines IX—IX of FIG. 7.

FIG. 10 is a top plan view of the embodiment of FIG. 6.

FIG. 11 is an enlarged fragmentary sectional view of the flange end of the closure and the socket portion of the cap of the embodiment of FIG. 6.

DESCRIPTION OF THE PREFERRED EMBODIMENTS

FIGS. 1-5 illustrate a dispensing cap closure 10 having a cup-shaped base cap portion 11 and a swivelable closure portion 12 mounted thereon. The dispensing closure is preferably a lightweight construction made of molded plastic. With reference to FIGS. 1-3, the cap portion 11 is formed with a peripheral depending skirt 13 which sealably fits about a bottle neck 14 of a bottle receptacle containing, for example, fluent material. The peripheral skirt has a threaded upper region 15 which cooperates with corresponding threads formed about the bottle mouth opening 16, permitting sealable, removable attachment of the dispenser cap over the bottle mouth. The cap portion 11 is formed with a substantially planar top surface 17 which covers the bottle mouth opening 16.

The cap top surface 17 is formed with a transversely extending recessed wall portion 18 leading radially out through the circumferential edge of the top surface. The interior end of the recessed wall 18 is formed with a generally semicircular depressed socket portion 19 spaced apart from a dispensing orifice 20 extending through the bottom wall of the recess adjacent the leading end thereof. The dispensing orifice 20 freely communicates with the bottle mouth 16 and the contents of the bottle. The socket portion 19 is formed with a planar front sidewall surface 21 and a back sidewall surface 22 leading to the top surface 17.

As illustrated in FIG. 5, an upstanding post portion 23 is formed adjacent the socket front wall. The post portion has a rearwardly facing, upright bulbous end member 24, which extends into the recess of the socket 19. Forwardly of the post 23 is a transverse cross-bar planar surface 25 extending upraised from the bottom of the socket 19. The functions of the post and cross-bar features are described below.

The closure portion 12 is formed with a leading edge lip portion 30 which overhands the peripheral edge of the recessed wall 18 when the closure portion is in a closed condition as shown in FIG. 2. Spaced inwardly of the lip 30 is a plug or stopper member 31 formed on the undersurface of the closure portion dimensioned to be received in the dispensing orifice 20 in a substantially tight-fitting sealing engagement. The inward facing 32 and outward facing 33 edge surfaces of the stopper and dispensing orifice, respectively, are preferably beveled to ease engagement of the stopper 31 into the orifice 20. The rearward end of the closure portion 12 is formed with a downturned flange portion 34.

As illustrated in FIG. 4, the flange 34 is formed with opposed side surfaces 35 and 36 having recesses or depressions 37 and 38 respectively formed therein. Corresponding dimple members 39 and 40 project outward from opposite sidewall portions 41 and 42, respectively, of the socket 19 for fitting within the flange side surface recesses so as to mount the closure portion 12 for pivotal movement relative to the cap top 17 and permit a snap receipt of the flange 34 in the socket 19 to affix the closure portion 12 in the cap 11. The closure portion 12 is pivotal between a first extreme position, as shown in FIG. 2, whereby the closure is substantially horizontally disposed and the stopper 31 is received in the dispensing orifice 20 and a second extreme open position, as shown in FIG. 3, whereby the closure is bent back slightly from a vertical line 50.

The flange 34 defines a downwardly extending back or end wall surface 45 which is movable within the socket cavity 19. Formed generally centrally along the flange back wall 42 is a T-shaped opening 43 dimensioned to receive the upright bulbous end 24 of the post 23 during pivotal movement of the closure portion 12. The opening 43 contains a relatively narrowed throat portion 44 which opens out beneath the flange back wall 45. The throat opening 44 is of a width less than the width of the post bulb 24. When the closure portion 12 is initially pivoted such that the stopper 31 is raised over the recessed wall 18 to approaching 90° from the orifice 20, the bulb end 24 is forced into the throat portion 44 providing a resilient force for pulling or biasing the flange back wall 45 relatively forwardly in the socket 19. This action causes the closure portion 12 to be bent backward over the top surface 17 to an extreme open position pulling the stopper 31 fully out of the flow path through the dispensing orifice 20. The material of at least one of the post 23 and flange 34 is sufficiently yieldable to allow the bulb end 24 to be passed through the throat opening 44 during pivotal movement of the closure portion 12. To remove and mount the closure portion 12 on the cap 11, the closure portion must be vertically positioned such that the opening 43 is aligned with the post end member 24 as shown in FIG. 5.

Operation of the dispensing cap closure 10 is as follows. With the closure portion 12 positioned in a closed condition, shown in FIG. 2, the closure portion 12 is lowered into the cap recess 18 so as to extend in substantially horizontal fashion with the planar upper surface of the closure portion substantially flush with the planar top surface 17 of the cap. In this condition, the stopper 31 is sealably received in the dispensing orifice 20 and, thereby, precludes dispensing of the bottle contents. The leading lip portion 30 of the closure 12 slightly overhangs the periphery of the cap top surface 17, so that the user is free to apply an upward force to the closure portion 12 with a finger for opening.

The closure portion 12 is dislodged from its closed condition in a two-stage movement. The initial movement passes the closure portion 12 to an upraised position approaching the vertical line 50, which represents a plane orthogonal to the top surface 17. This initial movement of the closure portion is brought about by applying a slight upward force against the protruding lip 30 or may be brought about by applying a downward force on the upper surface of the closure adjacent the flange back wall 45 in the direction of the socket recess. Opening may be further facilitated by providing for slight compression of the stopper member 31 as it fits into the dispensing opening 20, so as to arrange for a resilient reaction force to be applied against the stopper surface after the stopper has been raised a predetermined distance within the dispensing orifice. This reaction force may be such that the closure portion 12 pops out of closed condition and snap travels through the first state of movement. As the closure portion 12 is raised relative to the recessed wall portion 18, the flange 34 rotates within the socket 19 about the projecting dimple members 39 and 40.

As the closure portion 12 approaches the vertical line 50, the bulb end 24 is forced into the throat opening portion 44 and there results a second stage movement whereby the closure portion 12 is pulled to a fully bent back position shown in FIG. 3. In this full open condition, the closure portion 12 will no longer be obstructing discharge flow through the dispensing orifice 20. In the extreme open position, the closure portion 12 lies in a plane approximately 30° beyond the vertical. To prevent the closure portion 12 from being bent back further and, thereby, precluding the closure portion from being snapped out of connection in the socket 19 by being bent back too far away from the dispensing orifice 20, the flange end wall 45 abuts against the planar surface of the cross-bar extension 25. A slanted planar surface 51 is formed along the back wall 22 of the socket 19 to cooperatively receive the upper surface of the closure portion 12 resting thereagainst in this extreme open position. The planar surface 25 and back wall surface 51 serve to a stop surfaces which pin the closure portion 12 in its bent back extreme open condition so that further backward movement is not possible and the closure portion 12 cannot be accidentally pivoted out of the socket 19.

FIGS. 6 through 11 illustrate a modification of the embodiment of FIGS. 1 through 5. In the modified embodiment the bulbous headed post and narrow throated opening are not utilized. Instead the closure is maintained in the full open position by means of opposed projecting pads on the flange end and cooperative projecting bosses formed in the forward wall of the socket. The pads and bosses are dimensioned with respect to one another such that an interference relationship is created as the closure rotates to the full open position, first bringing the pads into initial contact with the lower portion of the bosses, and thereafter maintaining a pressed friction contact between the pads and the bosses as the closure is rotated beyond the vertical to the full open position.

As shown in FIG. 6, the dispensing closure includes a base cap portion **11*a* and a pivotable closure portion 12*a*. The top 17*a* of the cap portion is provided with a recess 18*a* which includes a dispensing orifice 20*a* adapted to be closed by a stopper 31*a* formed on an undersurface of the closure 12*a***.

As best shown in FIGS. 7 and 8, the recess **18*a* terminates at its back portion in a socket 19*a* which includes a front wall or forward wall 60. The socket is depressed below the recess 19*a* and the forward wall 60 forms the dividing wall between the recess and socket. The forward wall has projecting therefrom a central post 61 and a pair of bosses 62** lying on either side and spaced from the central post.

As best illustrated in FIG. 11, the bosses 62 have an arcuate surface 64 formed at the juncture of the top 65 and side 66 walls of the boss.

The closure **12*a* is provided with a flange end 68 similar to the flange 34 defining a downwardly extending back or end wall surface 69 which is movable within the socket 19*a*. The free end 70 of the flange 68 has spaced pads 71 extending therefrom and is further provided with a central opening 72 for receipt of the post 61**.

As shown in FIG. 11, the free end 70 is preferably provided with a length and slope such that when the closure **12*a* is pivoted about the dimple recess connection 80 that the free end would clear or just slightly engage the curvature 64 of the posts. In the area of the posts, however, the pads 71 increase the length of the flange beyond the free end 70. When the pads engage the bosses, initial resistance to further rotation of the closure is encountered. However, due to the resiliency of the materials, the resiliency or slop of the dimple-recess connection between the cup portion and the closure and the geography of the surface 64 of the bosses and the pads, after an initial point of resistance, further rotation of the closure will cause the pads to ride upwardly on the arcuate surface. After a further motion, a resistance to motion will be encountered which is considerably less than the resistance initially encountered upon the contact between the pads and the posts. This reduction in resistance gives a feeling to the opening of the closure which is similar to a snap over center connection. As this lessening of resistance is encountered, the closure will be quickly moved to the full open position shown in FIG. 8 where the top of the closure has now encountered the chamfered back surface 90 of the recess. At this point, the pads may still engage the top of the arcuate surface 64** of the post or, if desired, can in fact move just beyond the top of the posts presenting a semi-locked open condition. Removal of the closure by further opening rotation of the closure is prevented by engagement of the closure opening with the post which projects further into the socket than do the bosses and which therefore engages or is engageable with the bight of the opening to prevent further rotational movement of the closure.

It will thus be appreciated that the opposed pads and bosses provide opposed engageable means for restricting movement of the closure member towards the full open position, for retaining the closure member at the full open position, and for restricting movement of the closure member away from the full open position.

As shown in FIG. 8, the stopper **31*a* may include a slightly enlarged diameter head 91 adjacent its free end having a diameter greater than the bottom of the dispensing opening 20*a* so that when the stopper is fully closed, as shown in FIG. 7, the enlarged head 91 will project into the interior of the cup portion and overlie a portion of the undersurface 92** of the cup portion providing a secure closure.

In the embodiments illustrated, the cup portion top **17*a* is substantially planar with the recess extending downwardly thereinto so that when the closure is closed the top of the closure is substantially planar with the remaining portions of the cap. Of course, if desired, instead of a recess, the socket could be formed directly in a portion of the top 17***a* in a manner that allowed the closure to lie on a plane slightly higher than the remainder of the top. If necessary, the dimples could then be provided in a raised wall portion.

Although various minor modifications may be suggested by those versed in the art, it should be understood that I wish to embody within the scope of the patent warranted hereon all such modifications as reasonably and properly come within the scope of my contribution to the art.

I claim as my invention:

1. A dispensing closure comprising a cap portion having a top surface, a socket portion recessed in said top, a dispensing opening through said top spaced from the socket, said socket having a forward wall portion and side wall portions, a closure member having a rear depending flange and a depending stopper spaced from the flange for closing the opening, a pivot connection between the closure member and the cap, the closure member movable about the connection from a first position with the stopper closing the opening to a second position with the stopper elevated above the top surface, the closure member rotating in excess of 90° rotation from the first position to the second position, the flange moving within the socket during the said rotation, opposing engaging means on the socket forward wall portion and on the closure member flange engaged by rotational movement of the flange for retaining the closure member in the second position, the engaging means comprising at least one stationary projecting boss on the forward wall extending rearwardly into the socket beyond the forward wall and engageable with an end portion of the flange upon rotational movement of the flange towards and away from the second position, the engagement upon rotational movement of the flange providing resistance to movement of the closure member relative to the cap portion both to the second position from adjacent the first position and towards the first position from the second position whereby the closure portion may be retained in the second position.

2. The closure of claim 1 wherein the boss has an arcuate face from a top surface thereof, the arcuate face extending downwardly and rearwardly with respect to the socket.

3. The device of claim 2 wherein the flange has an end face, the end face having at least one raised pad thereon, the pad aligned with the boss.

4. The device of claim 3 wherein the closure is provided with side wall portions adjacent the flange, the side wall portions positioned opposed to side wall portions of the socket, the pivot connection between the closure and the socket being at the adjacent opposed side walls of the closure and socket, the flange moving in the socket during rotational movement of the closure about said connection, movement of the flange moving the end of the flange about an arc, the pads and bosses dimensioned and spaced with regard to said arc to provide an interference fit between said pads and arcuate surface of said boss, the material of at least one of the cap portion and closure being resilient whereby engagement of the pads with the arcuate surface produces a frictional resistance to relative movement.

5. The closure of claim 4 wherein the pads do not initially engage the bosses until the closure member has moved from the first position to a position intermediate the first and second positions.

6. The closure of claim 1 wherein the engaging means further comprises a post projecting from the socket forward wall into the socket and an aligned opening in the flange opening from the end of the flange, the post and opening dimensioned whereby when the closure is in the second position the post substantially fills the opening whereby further rotational movement of the closure is prevented by engagement between the end of the post and the bottom of the opening in the flange.

7. A plastics dispensing closure for containers comprising a cup shaped base portion having a circumferential depending flange and a top surface, a recess in the top surface, a socket portion recessed in said top surface open to said recess adjacent one end thereof, dispensing opening through said top surface open to said recess, a closure member pivotably connected to said cap portion having a depending flange received in said socket and a stopper receivable in said dispensing opening, the pivotable connection between the closure member and the cap allowing rotational movement of the closure member from a first position with the stopper in the dispensing opening to a second position in excess of 90° rotation from the first position with the closure member projecting upwardly from the cup portion, rotational movement between the first and second positions rotating the flange in the socket, the socket having a forward wall, the flange having a free end, engagement means on the forward wall and the free end being brought into engagement by rotation from the first position towards the second position, the engagement means including at least one projecting boss on the forward wall extending rearwardly into the socket for contacting portions of the free end of the flange, said boss including an arcuate surface extending downwardly and rearwardly from a top of the boss, the arcuate surface dimensioned with respect to an arc of movement of the free end of the flange to produce an engagement between portions of the free end of the flange and the arcuate surface upon rotation of the closure from the first position towards the second position, engagement of the free end portions of the flange with the arcuate surface not occurring until a position intermediate the first position and the second position, engagement of the portions of the free end of the flange with the arcuate surface providing a frictional resistance to movement of the closure member whereby the closure member will be retained in an open position after engagement of the free end portions with the arcuate surface.

8. A closure member of claim 7 wherein the free end portions include projecting pads formed adjacent the end of the flange.

9. A device according to claim 8 wherein two bosses and two pads are provided, the bosses and pads being spaced to either side of a center line of the forward wall and flange.

10. The device of claim 9 further including a projecting post on said forward wall extending into said socket, an opposed opening in the flange aligned with the post, the opening having a bight dimensioned with respect to the post whereby an end of the post is engagable with the bight of the opening to prevent further rotational movement of the closure beyond the second position.

11. The device of claim 10 wherein the stopper has a length greater than the depth of the dispensing opening, the stopper having a head portion adjacent a free end thereof, at least one of the dispensing opening and stopper being resilient whereby the head end can be forced through the dispensing opening, the dispensing opening having a minimum diameter less than the diameter of the head end, the head end, when forced through the dispensing opening overlying an undersurface of the cup portion surrounding the dispensing opening whereby the closure can be snapped in the first position and retained therein by engagement between the head portion and the undersurface of the cup portion adjacent the dispensing opening.

* * * * *